US007777604B2

(12) United States Patent
Matsubayashi et al.

(10) Patent No.: US 7,777,604 B2
(45) Date of Patent: Aug. 17, 2010

(54) IGNITION COIL

(75) Inventors: Shuichi Matsubayashi, Tsurugashima (JP); Ikuo Hirayama, Tsurugashima (JP); Atsushi Iwami, Kariya (JP); Takeshi Morimoto, Tajimi (JP)

(73) Assignees: Toyo Denso Kabushiki Kaisha, Tokyo (JP); Denso Corporation, Kariya (JP)

( * ) Notice: Subject to any disclaimer, the term of this patent is extended or adjusted under 35 U.S.C. 154(b) by 84 days.

(21) Appl. No.: 12/150,208

(22) Filed: Apr. 25, 2008

(65) Prior Publication Data

US 2008/0266040 A1 Oct. 30, 2008

(30) Foreign Application Priority Data

Apr. 27, 2007 (JP) ..... 2007-119213
Apr. 27, 2007 (JP) ..... 2007-119214

(51) Int. Cl.
*H01F 21/00* (2006.01)
*H01F 27/24* (2006.01)

(52) U.S. Cl. ..... 336/110; 336/212

(58) Field of Classification Search ..... 336/110, 336/212

See application file for complete search history.

(56) References Cited

U.S. PATENT DOCUMENTS 5,485,135 A * 1/1996 Hipp ..... 336/96
5,729,505 A * 3/1998 Murata et al. ..... 336/178

FOREIGN PATENT DOCUMENTS

JP 03-116704 5/1991
JP 10-258442 9/1998
JP 2001210534 A * 8/2001

* cited by examiner

*Primary Examiner*—Anh T Mai
(74) *Attorney, Agent, or Firm*—Cohen Pontani Lieberman & Pavane LLP

(57) ABSTRACT

A high-strength ignition coil that can prevent distortion arising from pin marks formed on a surface of a core and makes it less likely for insulating resin to be cracked. The coil assembly is housed in a coil case. A casting material is filled into a gap between the coil case and the coil assembly and gaps which the coil assembly has. The coil assembly is comprised of a coil pair including a cylindrical primary coil and a secondary coil disposed concentrically with the primary coil, and a core. The core is fitted into a central space of the coil pair and forms a magnetic path. The core is coated with mold resin. Concave portions of pin marks formed on a mold resin coating by removal of core fixing pins when the mold resin coating is formed are filled with mold resin.

12 Claims, 8 Drawing Sheets

IGNITION COIL

BACKGROUND OF THE INVENTION

1. Field of the Invention

The present invention relates to an ignition coil, and in particular to an ignition coil of a typical internal combustion engine and an ignition coil directly mounted on a plug hole of an engine.

2. Description of the Related Art

In internal combustion engines such as vehicle engines, an ignition coil and an ignition plug are used as detonators that burn gasoline as fuel.

As a core that is a constructional member of an ignition coil, for example, a core of the type that is buried in insulating resin through insert molding has been used in many cases so as to improve corrosion resistance.

Examples of publications of prior arts relating to a method of manufacturing such an insert-molded product include Japanese Laid-Open Patent Publication (Kokai) No. H10-258442.

FIG. 7 is a sectional view showing a mold for use in the method of manufacturing the insert-molded product disclosed in the above publication.

As shown in FIG. 7, to prevent an insert 71 from becoming displaced from a normal position at the time of injection and filling of a molten material, at least one side of the long or large-area insert 71 is supported and held in the air inside a product cavity 73 of the mold by a plurality of insert pins 72, and in this state, the molten material is injected and filled into the product cavity 73 from, for example, a gate 74, so that an insert-molded product is manufactured.

On the other hand, examples of publications of prior arts relating to an ignition coil include Japanese Laid-Open Patent Publication (Kokai) No. H03-116704.

FIG. 8 is a longitudinal sectional view showing the conventional ignition coil disclosed in the above publication. As shown in FIG. 8, the ignition coil is comprised mainly of a primary coil 65, a secondary coil 66 that is concentrically wound around an outer peripheral portion of the primary coil 65, and a core 61 of which part is fitted into a central space of the primary coil 65. The core 61 is comprised of a linear energized portion 62 fitted into a central space of a coil pair including the primary coil 65 and the secondary coil 66, a closed magnetic path forming portion 63 that is substantially square U-shaped and sandwiches both ends of the energized portion 62, and a permanent magnet 64 disposed in an air gap between the energized portion 62 and the closed magnetic path forming portion 63.

FIG. 9 is a partially enlarged view showing the closed magnetic path forming portion 63 of the core 61 appearing in FIG. 8, and FIG. 10 is a longitudinal sectional view showing the closed magnetic path forming portion 63 appearing in FIG. 8. As shown in FIGS. 9 and 10, a projected portion 68 for positioning the permanent magnet 64 is provided around part of a joint surface 67 of the closed magnetic path forming portion 63 and the permanent magnet 64.

Such a coil assembly having the primary coil 65, the secondary coil 66, and the core 61 forming a closed magnetic path is housed in a coil case, and an insulation casting material is injected into gaps between the constructional members, whereby the ignition coil is formed.

However, according to the prior art shown in FIG. 7, if the insert-molded product is used as a core that is a constructional member of an ignition coil, the following problem arises. Specifically, in a case where concave portions of pin marks formed on a surface of the core by removal of fixing pins at the time of insertion are left as they are, when a coil assembly including the core is fitted into a coil case, and insulating resin as a casting material is injected into a gap between the coil assembly and the coil case, boundaries between the concave portions of the pin marks and the insulating resin become distorted, and the insulating resin is cracked due to the distortion.

Moreover, according to the prior art shown in FIGS. 8 to 10, the following problem arises. Specifically, part of the edge of the permanent magnet 64 in the coil assembly is exposed from a surface of the core 61, and in a case where at the time of assembly, the coil assembly is housed as it is in the coil case, and the casting material is injected into a gap between the coil case and the coil assembly to form the ignition coil, the permanent magnet and the casting material are joined together. Then, after the insulating resin as the casting material is hardened, the insulating resin tends to be cracked due to distortion thereof in the vicinity of the edge of the permanent magnet.

SUMMARY OF THE INVENTION

The present invention provides a high-strength ignition coil that can prevent distortion arising from pin marks formed on a surface of a core and makes it less likely for insulating resin to be cracked even in a case where a core as an insert product is used as a constructional member of a coil assembly.

The present invention also provides a high-strength ignition coil that can prevent insulating resin from becoming distorted in the vicinity of the edge of a permanent magnet as a constructional member of a core that forms a closed magnetic path and thus prevent cracking of the insulating resin.

Accordingly, in a first aspect of the present invention, there is provided an ignition coil comprising a coil case, a coil assembly housed in the coil case, and a casting material filled into a gap between the coil case and the coil assembly and gaps which the coil assembly has, wherein the coil assembly has a coil pair including a cylindrical primary coil and a secondary coil disposed concentrically with the primary coil, and a core that is fitted into a central space of the coil pair and forms a magnetic path, the core is coated with mold resin, and concave portions of pin marks formed on a mold resin coating by removal of core fixing pins when the mold resin coating is formed are filled with mold resin.

According to the first aspect of the present invention, because the core is coated with mold resin, and the pin marks formed on a mold resin coating by removal of the core fixing pins when the mold resin coating is formed are filled with mold resin so as to fill up the concave portions of the pin marks, distortion at boundaries between the concave portions of the pin marks on the surface of the core and insulating resin as the casting material can be suppressed, and hence cracking of the insulating resin can be prevented.

The first aspect of the present invention can provide an ignition coil, wherein the mold resin coating is coated with the mold resin so as to fill up the concave portions of the pin marks.

According to the first aspect of the present invention, because the mold resin coating is coated with the mold resin so as to fill up the concave portions of the pin marks, the step of filling the pin marks with insulating resin can be simplified, and the strength of the core as a whole can be increased.

The first aspect of the present invention can provide an ignition coil, wherein a film thickness of the mold resin coating at the time of double coating for filing up the concave portions of the pin marks is 0.5 mm to 2.0 mm.

According to the first aspect of the present invention, because the film thickness of the mold resin coating at the time of double coating for filing up the concave portions of the pin marks is 0.5 mm to 2.0 mm, the amount of usage of mold resin can be moderate.

The first aspect of the present invention can provide an ignition coil, wherein the coil pair includes the primary coil wound around a cylindrical primary coil bobbin, and the secondary coil wound around a cylindrical secondary coil bobbin that has a larger diameter than a diameter of the primary coil bobbin and is disposed concentrically with the primary coil bobbin, and at least part of the core is fitted into a central space of the primary coil bobbin.

According to the first aspect of the present invention, because the coil pair includes the primary coil wound around the cylindrical primary coil bobbin, and the secondary coil wound around the cylindrical secondary coil bobbin that has a larger diameter than the diameter of the primary coil bobbin and is disposed concentrically with the primary coil bobbin, and at least part of the core is fitted into the central space of the primary coil bobbin, the ignition coil as a whole can be reduced in size.

The first aspect of the present invention can provide an ignition coil, wherein the core comprises a combination of a plurality of core members, and the mold resin is filled into the pin marks formed on mold resin coatings of the core members to fill up the concave portions of the pin marks.

According to the first aspect of the present invention, because the core is comprised of the combination of the plurality of core members, the ability of the coil assembly to be assembled can be improved, and assembly can be made easier.

The first aspect of the present invention can provide an ignition coil, wherein the core comprises a combination of a plurality of core members, and forms a closed magnetic path in which the plurality of core members are joined together with a permanent magnet being placed in at least one joint portion, the plurality of core members except joint surfaces thereof are coated with insulating resin, and the permanent magnet is housed in a housing space that is surrounded by two joint surfaces forming the one joint portion of the core members and the mold resin coating provided such as to project out from the joint surfaces.

According to the first aspect of the present invention, because the core forms the closed magnetic path in which the plurality of core members are joined together with the permanent magnet being placed in at least one joint portion, and the permanent magnet is housed in the housing space that is surrounded by the two joint surfaces forming the one joint portion of the core members and the mold resin coating provided such as to project out from the joint surfaces, the permanent magnet does not expose itself from the surface of the core and thus does not come into contact with insulating resin as the casting material, and hence the insulating resin can be prevented from being cracked due to distortion thereof in the vicinity of the edge of the permanent magnet.

The first aspect of the present invention can provide an ignition coil, wherein the casting material is insulating resin.

According to the first aspect of the present invention, because insulating resin is used as the casting material, leakage of electric current can be prevented.

Accordingly, in a second aspect of the present invention, there is provided an ignition coil comprising a coil case, a coil assembly housed in the coil case, and a casting material filled into a gap between the coil case and the coil assembly and gaps which the coil assembly has, wherein the coil assembly has a coil pair including a cylindrical primary coil and a secondary coil disposed concentrically with the primary coil, and a core that is fitted into a central space of the coil pair and forms a magnetic path, the core forms a closed magnetic path in which a plurality of core members that can be separated are joined together with a permanent magnet being placed in at least one joint portion, the plurality of core members except joint surfaces thereof are coated with insulating resin, and the permanent magnet is housed in a housing space that is surrounded by two joint surfaces forming the one joint portion of the core members and coatings of the insulating resin provided such as to project out from the joint surfaces.

According to the second aspect of the present invention, because the permanent magnet is housed in the housing space that is surrounded by the two joint surfaces forming the one joint portion of the core members and the coatings of the insulating resin provided such as to project out from the joint surfaces, the permanent magnet does not expose itself from the surface of the core and thus does not contact insulating resin as the casting material, and hence the insulating resin can be prevented from being cracked due to distortion thereof in the vicinity of the edge of the permanent magnet.

The second aspect of the present invention can provide an ignition coil, wherein the coatings of the insulating resin provided such as to project out from the joint surfaces are insulation coatings provided such as to partially project out from outer peripheral portions of the two opposed joint surfaces of the one joint portion, and through engagement of the insulation coatings, the insulation coatings cover the total circumferences of the joint surfaces to form the housing space.

According to the second aspect of the present invention, because the insulation coatings are provided such as to partially project out from the outer peripheral portions of the two opposed joint surfaces of the two core members in the one joint portion, and as a result of engagement of the insulation coatings, the insulation coatings cover the total circumferences of the joint surfaces to form the housing space to house the permanent magnet, the permanent magnet interposed between the core members can be reliably covered with the insulation coatings. Thus, cracking due to the distortion of the insulating resin as the casting material on the surface of the permanent magnet can be reliably prevented.

The second aspect of the present invention can provide an ignition coil, wherein the joint surfaces forming the one joint portion are inclined at a predetermined angle to a direction in which the core members are joined together.

According to the second aspect of the present invention, because the joint surfaces forming the one joint portion are inclined at a predetermined angle to the direction in which the core members are joined together, the permanent magnet increased in size can be interposed between the joint surfaces, and hence reverse bias can be increased, resulting in secondary output from the core increasing.

The second aspect of the present invention can provide an ignition coil, wherein a joint portion other than the one joint portion has a concave surface and a convex surface that are joined together.

According to the second aspect of the present invention, because the joint portion other than the one joint portion includes the concave surface and the convex surface that are joined together, the joint strength of the core members can be improved.

The second aspect of the present invention can provide an ignition coil; wherein the core forms the closed magnetic path through engagement of substantially square U-shaped two core members.

According to the second aspect of the present invention, because the core forms the closed magnetic path through engagement of the substantially square U-shaped two core members, the ability of the coil assembly to be assembled can be increased.

The second aspect of the present invention can provide an ignition coil, wherein the coil assembly comprises the primary coil wound around a cylindrical primary coil bobbin, and the secondary coil wound around a cylindrical secondary coil bobbin that has a larger diameter than a diameter of the primary coil bobbin and is disposed concentrically with the primary coil bobbin, and at least part of the core is fitted into a central space of the primary coil bobbin.

According to the second aspect of the present invention, because the coil assembly is comprised of the primary coil wound around the cylindrical primary coil bobbin, and the secondary coil wound around the cylindrical secondary coil bobbin that has a larger diameter than the diameter of the primary coil bobbin and is disposed concentrically with the primary coil bobbin, and at least part of the core is fitted into the central space of the primary coil bobbin, the ignition coil as a whole can be reduced in size.

The second aspect of the present invention can provide an ignition coil, wherein the casting material is insulating resin.

According to the second aspect of the present invention, because insulating resin is used as the casting material, leakage of electric current can be prevented.

The features and advantages of the invention will become more apparent from the following detailed description taken in conjunction with the accompanying drawings.

DETAILED DESCRIPTION OF THE PREFERRED EMBODIMENTS

The present invention will now be described in detail with reference to the drawings showing a preferred embodiment thereof.

Figure 1:
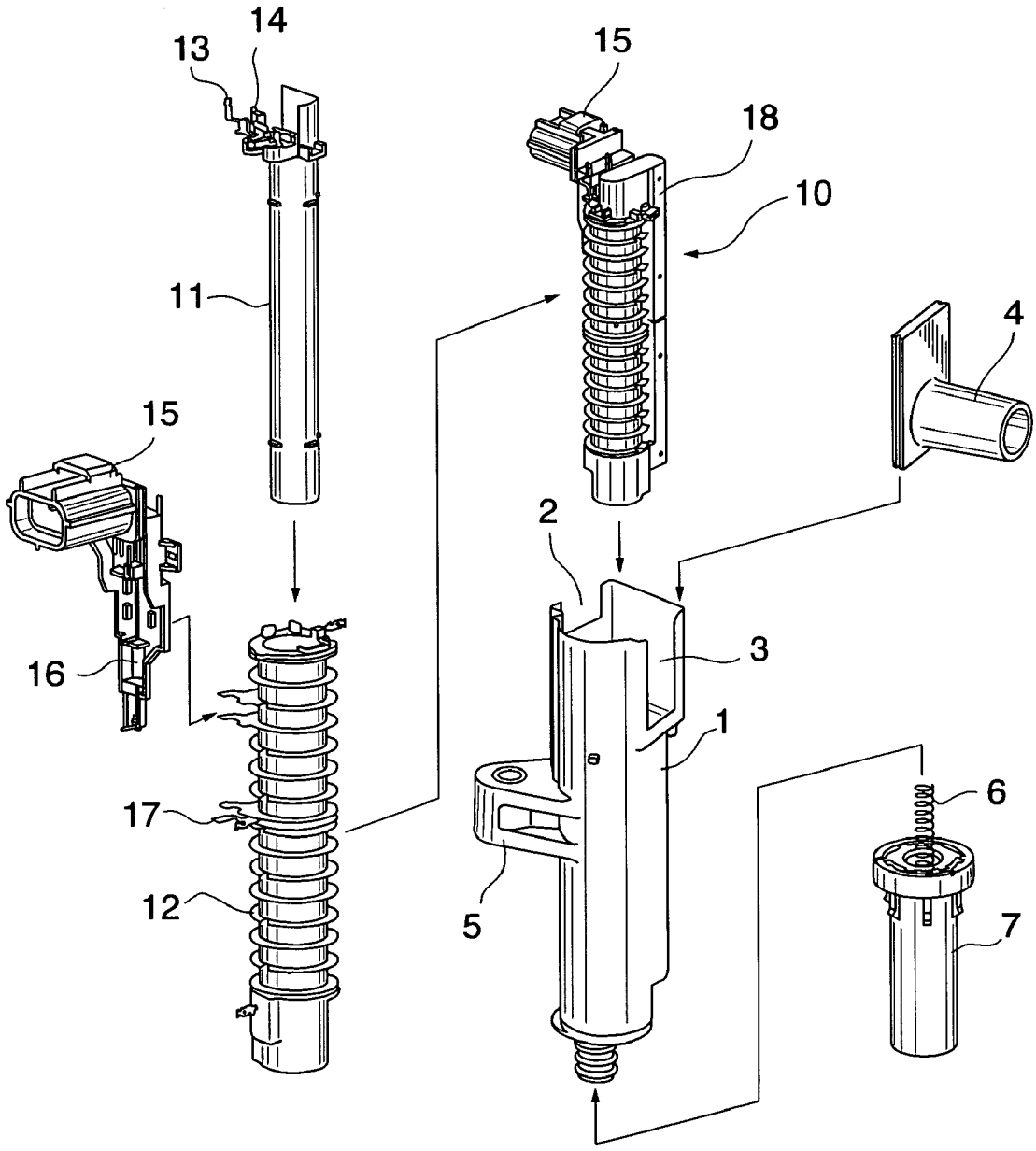
FIG. 1 is an assembly diagram showing an ignition coil for an internal combustion engine according to an embodiment of the present invention.

FIG. 1 is an assembly diagram showing an ignition coil for an internal combustion engine according to an embodiment of the present invention.

As shown in FIG. 1, the ignition coil is of a dual ignition type having two secondary output terminals, and is comprised mainly of a housing 1 as a coil case, and a coil assembly 10 fitted into the housing 1.

The coil assembly 10 is comprised of a substantially cylindrical primary coil bobbin 11 around which a primary coil (not shown) is wound, and a substantially cylindrical secondary coil bobbin 12 around which a secondary coil (not shown) is wound and of which diameter is larger than the diameter of the primary coil bobbin 11. The secondary coil bobbin 12 around which the secondary coil is wound is disposed outside and concentrically with the primary coil bobbin 11 around which the primary coil is wound. The primary coil and the secondary coil thus form a pair of coils that are concentrically arranged.

Primary terminals 13 and 14 are forcibly pressed into one end of the primary coil bobbin 11, and the start of winding and the end of winding of the primary coil are connected to the primary terminals 13 and 14, respectively, by fusing or the like. The primary terminals 13 and 14 are inserted into a connector 15 from one end thereof, and the connector 15 is fixed at a predetermined location of the secondary coil bobbin 12.

A center core portion of a core 18 forming a magnetic path is fitted into a central space of the primary coil bobbin 11 along the central axis of the coil pair including the primary coil and the secondary coil arranged concentrically, and as a result, the coil assembly 10 comprised mainly of the primary coil, the secondary coil, and the core 18 is constructed.

Figure 2:
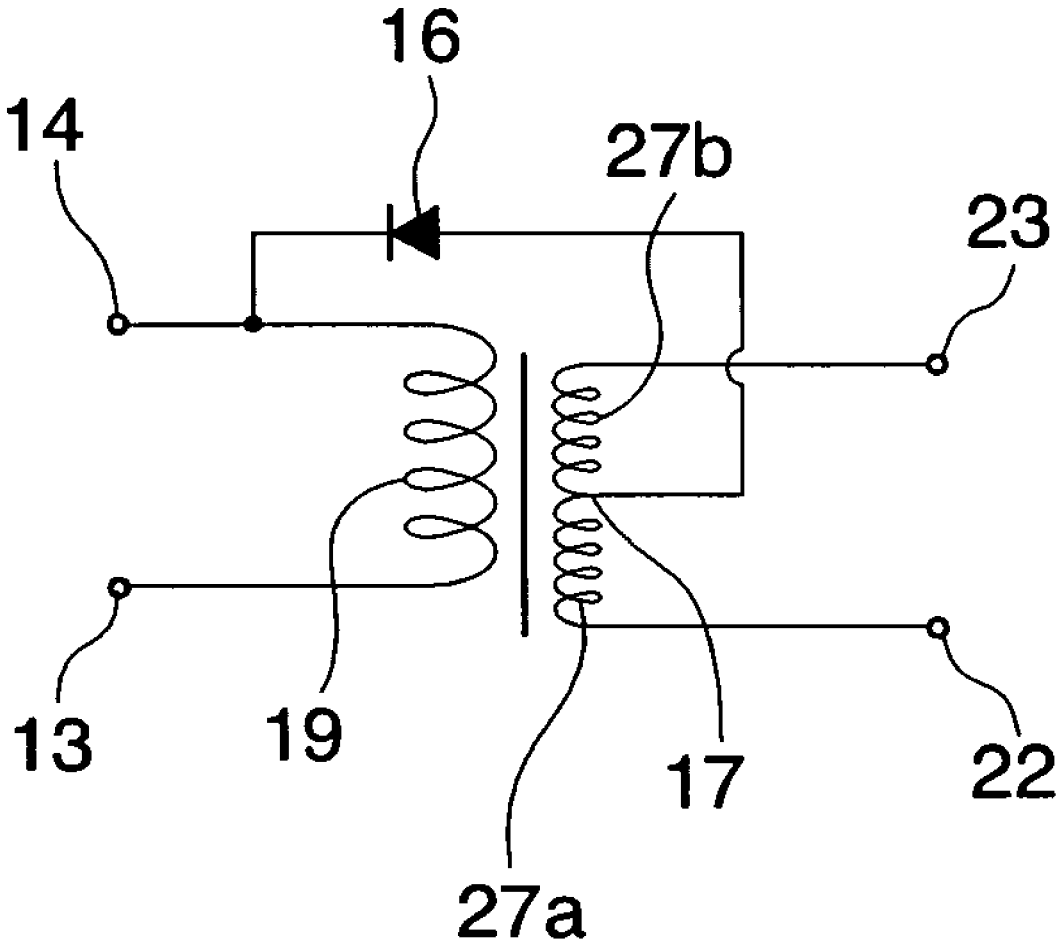
FIG. 2 is a connection wiring diagram showing a coil assembly appearing in FIG. 1.

FIG. 2 is a connection wiring diagram showing the coil assembly shown in FIG. 1.

As shown in FIG. 2, the primary terminal 13 as the start of winding of the primary coil 19 is connected to a control circuit (not shown), which controls the conduction of the primary coil, via the connector 15 (see FIG. 1). Moreover, a cathode of a diode 16 (see FIG. 1) fixed to the connector 15 is connected to the primary terminal 14 as the end of winding of the primary coil 19 and connected to the positive (+) side of a battery (not shown) via the connector 15. On the other hand, an anode of the diode 16 is, for example, L-shaped, and is connected at the L-shaped portion to a midtap 17 as the midpoint of the secondary coil wound around the secondary coil bobbin 12 (see FIG. 1). Outer ends of the respective secondary coils 27*a* and 27*b* wound around the secondary coil bobbin 12 are connected to secondary output terminals 22 and 23, respectively.

As shown in FIG. 1, a cut portion 2 with which the above described connector 15 is to be engaged is provided at an opening end of an upper portion of the housing 1 as a coil case. A cut portion 3 with which an H/T tower 4 as a take-out end for secondary output is to be engaged is provided such as to face the cut portion 2 across the central axis of the housing 1. Moreover, a mounting flange 5 for fixing the ignition coil to an engine block is provided on an outer surface of the housing 1.

In the coil assembly 10 and the housing 1 constructed as described above, after the H/T tower 4 is engaged with the cut portion 3 of the housing 1, the coil assembly 10 is fitted into the housing 1 to engage the connector 15 of the coil assembly 10 with the cut portion 2, one secondary output terminal 23 is joined to the H/T tower 4, a plug cap 7 having a spring 6 therein is engaged with one end (lower end as viewed in FIG. 1) of the housing 1 as a connector for the other secondary output terminal 22, and insulating resin is filled into gaps between the constructional members, for example, a gap between the housing 1 and the coil assembly 10 and gaps which the coil assembly 10 has, whereby the ignition coil is formed.

Figure 3:
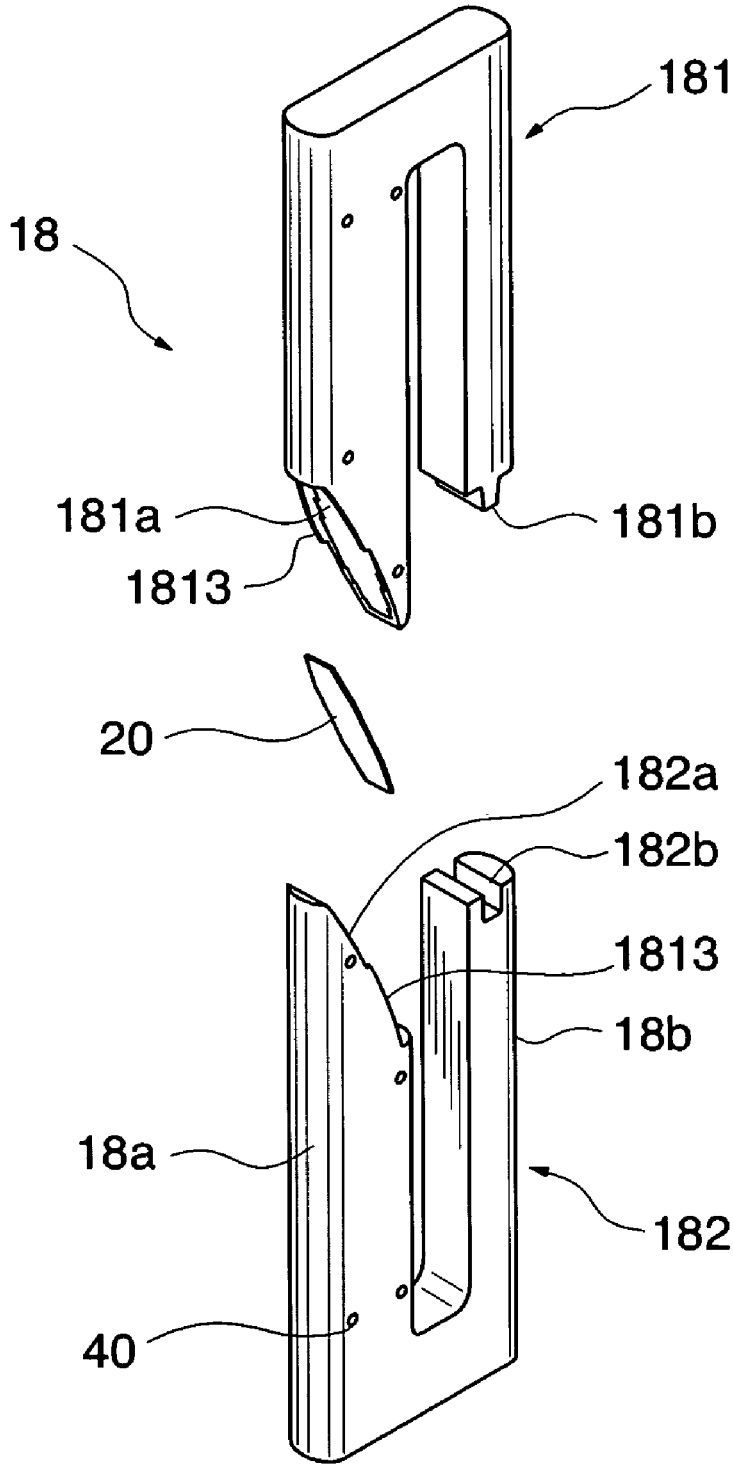
FIG. 3 is a perspective view showing a core that is a constructional member of the coil assembly.

A detailed description will now be given of the core that is the constructional member of the coil assembly in the ignition coil. FIG. 3 is a perspective view showing the core 18 that is the constructional member of the coil assembly.

As shown in FIG. 3, the core 18 is comprised of two core members 181 and 182 that are substantially square U-shaped. By combining the core members 181 and 182 together, for example, a closed magnetic path that is rectangular in frontal view is formed.

One joint portion of the core members 181 and 182 is an inclined joint portion inclined at a predetermined angle such as 10 to 20 degrees to the joining direction, i.e. the vertical direction as viewed in FIG. 3. That is, the core members 181 and 182 have inclined joint surfaces 181*a* and 182*a*, respectively. A plate-shaped permanent magnet 20 is interposed between the inclined joint surfaces 181*a* and 182*a*. Thus, a magnetic flux formed by the primary coil is reverse-biased, resulting in secondary output increasing.

Examples of joint portions other than the above-mentioned one joint portion include a joint surface formed by engagement of concave and convex surfaces. The core member 181 has, for example, a convex joint surface 181*b*, and the core member 182 has, for example, a concave joint surface 182*b*.

Portions of the core members 181 and 182 other than the above-mentioned joint surfaces, more specifically, surfaces of the core members 181 and 182 other than the above-mentioned joint surfaces and the flat surface of an upper end of the core member 181 are coated with mold resin. Insulating epoxy resin or polypropylene resin, for example, is used as the mold resin.

The mold resin 1813 around the inclined joint surfaces 181*a* and 182*a* of the core members 181 and 182 partially projects out from the inclined joint surfaces 181*a* and 182*a* by a predetermined height, that is, a height corresponding to the thickness of the magnet 20, for example, about 0.5 mm to 2.0 mm. When the core members 181 and 182 are engaged with each other, the projecting mold resin 1813 covers the total circumferences of the inclined joint surfaces 181*a* and 182*a*, so that a housing space for the magnet 20 surrounded by the inclined joint surfaces 181*a* and 182*a* and the projecting mold resin 1813 is formed.

At the time of forming a closed magnetic path by combining the core members 181 and 182 constructed as described above together, the plate-shaped magnet 20 is joined to a part of the inclined joint surface 181*a* of one core member 181 surrounded by the mold resin through magnetic force of the magnet 20, this joint surface is brought into abutment with the inclined joint surface 182*a* of the other core member 182 via the magnet 20, and other joint surfaces with no magnet interposed therebetween, for example, the concave and convex joint surfaces 181*b* and 182*b* are engaged with each other so that the closed magnetic path can be formed. At this time, a center core 18*a* of the core 18 extended in, for example, the vertical direction is fitted into a central space of the primary coil bobbin 11 of the coil assembly. 10, and a side core 18*b* parallel to the center core 18*a* is disposed along an outer surface of the secondary coil bobbin 12.

Because the plate-shaped magnet 20 is confined in the closed space (housing space) surrounded by the inclined joint surfaces 181*a* and 182*a* of the core members 181 and 182 and the mold resin coating 1813 provided such as to project out from the joint surfaces, a casting material does not contact the plate-shaped magnet 20 when the coil assembly 10 having the core 18 forming the closed magnetic path is housed in the housing 1, and the casting material is filled into the gaps between the constructional members and hardened to complete the ignition coil. Thus, stress can be prevented from being produced in the casting material at the edge of the magnet due to the interposition of the plate-shaped magnet between the joint surfaces, and this makes cracking less likely to occur and prevents the strength of the ignition coil from decreasing.

Moreover, because the joint surfaces between which the magnet is interposed are the inclined joint surfaces inclined at 10 to 20 degrees to the joining direction, a permanent magnet of a relatively large size can be used as the magnet, resulting in magnetic output from the core 18 increasing.

In the present embodiment, insulating resin is filled into pin marks formed when the core members 181 and 182 constituting the core 18 are coated with mold resin, so that surface projections and depressions can be reduced.

Figure 4:
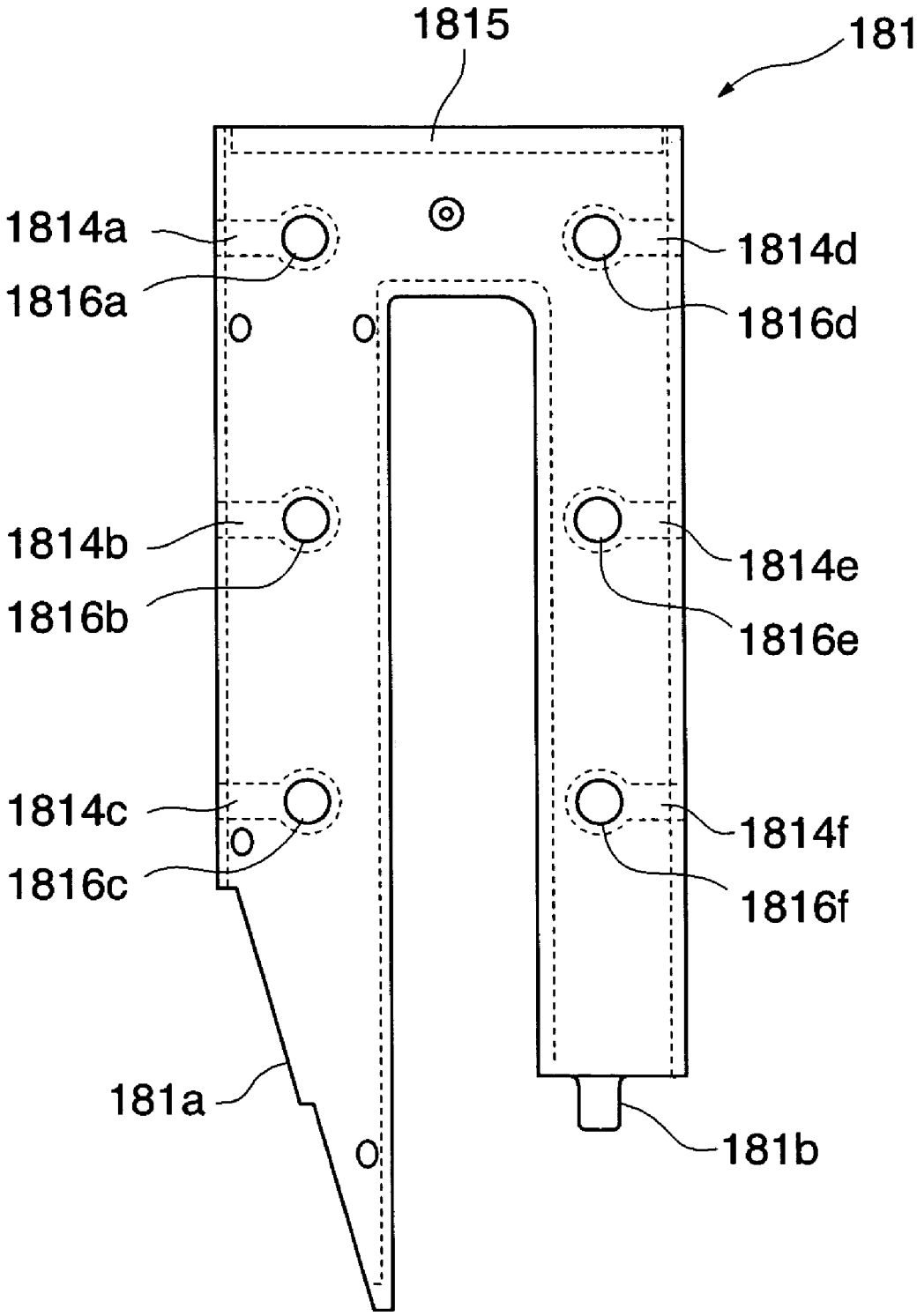
FIG. 4 is a front view showing a core member.
Figure 5:
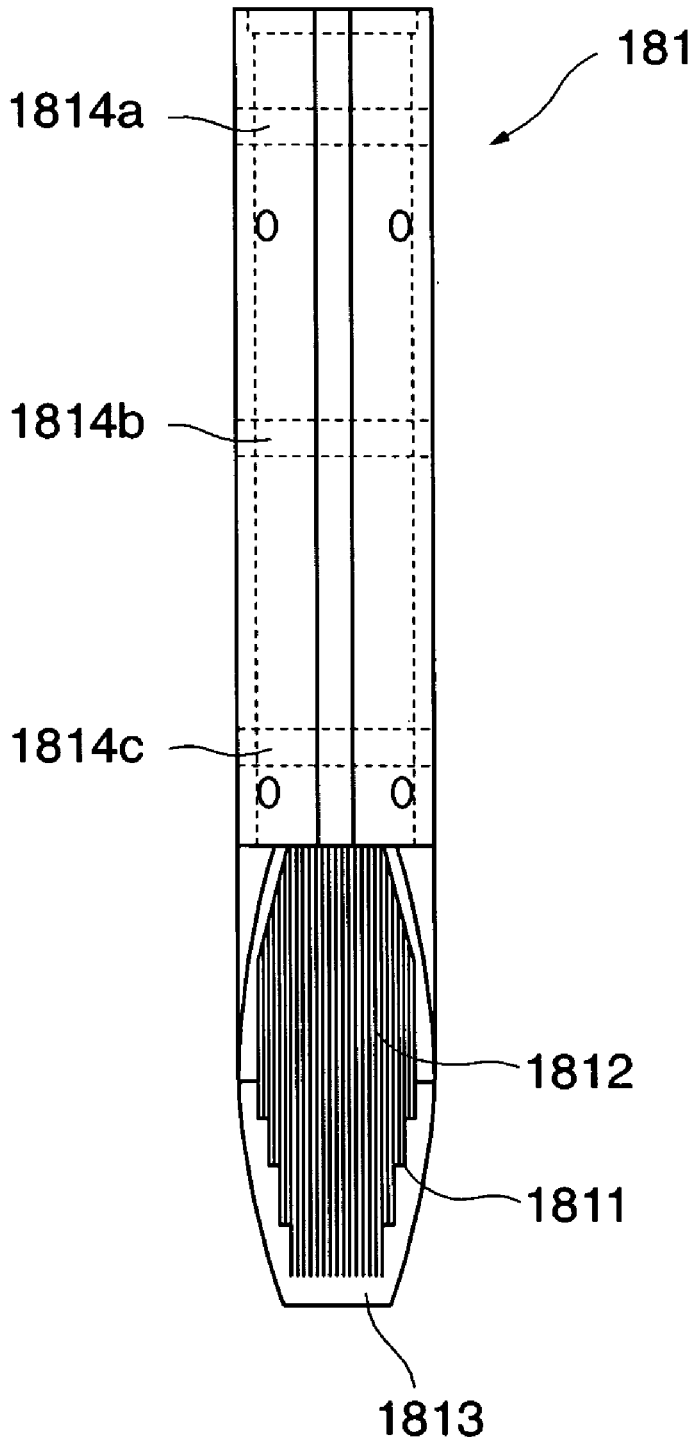
FIG. 5 is a left side view of FIG. 4.

FIG. 4 is a front view showing the core member 181 according to the present embodiment, and FIG. 5 is a left side view of FIG. 4.

As shown in FIG. 4, the core member 181 has a square U-shape opened downward in frontal view. As shown in FIG. 5, the core member 181 is comprised mainly of a core member main body 1812 having a laminated construction comprised of a plurality of directional silicon steel sheets 1811, and the mold resin coating 1813 formed on the surface of the core member main body 1812.

A molding step of covering the surface of the core member main body 1812 with mold resin is carried out as described below, for example. Specifically, the core member main body 1812 shown in FIG. 5 is housed in a product cavity of a mold, an upper flat surface 1815 and the lower inclined joint surface 181*a* and convex joint surface 181*b* are each supported by part of the mold, right and left six areas 1814*a* to 1814*f* in FIG. 4 are supported by respective fixing pins (not shown) each having a rectangular distal end, a total of twelve areas including areas 1816*a* to 1816*f* on a front surface of the core member 181 and the corresponding six areas on a rear surface of the core member 181 as viewed in the drawing are supported by respective fixing pins each having a keyhole-shaped distal end. These fixed areas are to become pin marks in the future. In this way, the core member main body 1812 as an insert is held in the air inside the product cavity, and in this state, a molten material is injected from a gate into the product cavity, so that a primary mold resin coating having a thickness of, for example, 0.5 mm to 2.0 mm is formed.

In the core member with the primary mold resin coating formed thereon, the directional silicon steel sheets 1811 are exposed from the upper flat surface 1815, the lower inclined joint surfaces 181*a* and convex joint surface 181*b*, the six fixing pin marks 1814*a* to 1814*f* having the rectangular distal ends, and the twelve pin marks having the keyhole-shaped distal ends on the front and rear surfaces (the rear surface is not shown).

In the present embodiment, so that the fixing pin marks 1814*a* to 1814*f* and 1816*a* to 1816*f* of the core member having the primary mold resin coating can be covered with mold resin, the primary mold resin coating is covered with mold resin so as to form a secondary mold resin coating. Specifically, as in the case of the formation of the primary resin coating, the upper flat surface 1815 and the lower inclined joint surface 181*a* and convex joint surface 181*b* in FIG. 4 are each supported by part of the mold, and arbitrary portions of the primary mold resin coating are supported as necessary, and in this state, a molten material is injected and filled into the product cavity to form the secondary mold resin coating having a thickness of, for example, 0.5 mm to 2.0 mm on the surface of the primary mold resin coating, whereby the pin marks 1814*a* to 1814*f* and 1816*a* to 1816*f* are filled with the mold resin. In this case, central portions of the keyhole-shaped arcs of the keyhole-shaped pin marks 1816*a* to 1816*f* which are filled with the mold resin are to be portions for extrusion using extruding pins.

The core member 182 (see FIG. 3) is processed in the same manner as in the case of the core member 181; i.e. a primary mold resin coating is covered with a secondary mold resin coating to fill up fixing pin marks formed when the primary mold resin coating is formed.

The core 18 is formed by combining the two core members 181 and 182 thus formed together, and is used as the constructional member of the coil assembly in the ignition coil.

Specifically, the cylindrical secondary coil bobbin 12 that has a larger diameter than the diameter of the primary coil bobbin 11 and around which the secondary coil is wound is disposed outside the cylindrical primary coil bobbin 11 around which the primary coil is wound, so that the coil pair is formed. Then, the plate-shaped magnet 20 is joined to the inclined joint surface 181*a* of the core member 181, an end of the square U-shaped core member 181 on the inclined joint surface side is fitted into the central space of the primary coil bobbin 11 from above the coil pair, an end of the other core member 182 on the inclined joint surface 182*a* side is similarly fitted into the central space of the primary coil bobbin 11 from below the coil pair, and the inclined joint surfaces 181*a* and 182*a* are joined together in the central space of the primary coil bobbin 11. At this time, on the outside of the coil pair, the concave and convex joint surfaces 181*b* and 182*b* are engaged with each other so as to form the closed magnetic path as the core 18. In this way, the coil assembly 10 is formed in which the center core portion 18*a* of the core 18 is fitted into the central space of the coil pair including the primary coil and the secondary coil arranged concentrically, and the side core 18*b* parallel to the center core 18*a* is disposed along the outer surface of the secondary coil bobbin 12. The coil assembly 10 is fitted into the housing 1 as shown in FIG. 1, and insulating resin is filled into the gaps between the constructional members to form the ignition coil.

In the present embodiment, because concave portions as the pin marks 1814*a* to 1814*f* and 1816*a* to 1816*f* formed when the primary mold resin coating is formed are filled with mold resin, projections and depressions on the surfaces of the core members 181 and 182 can be reduced. Thus, in the ignition coil that is formed by fitting the coil assembly 10 (see FIG. 1) having the core 18 comprised of the core members 181 and 182 as the constructional member into the housing 1, and injecting and filling insulating resin into the gaps between the constructional members, distortion at boundaries between the concave portions of the pin marks on the surface of the core 18 and insulating resin as the casting material can be suppressed, and hence cracking of the insulating resin can be prevented.

In the present embodiment, because the coating thickness of the secondary mold resin coating is 0.5 mm to 2.0 mm, the step of filling the concave portions as the pin marks 1814*a* to 1814*f* and 1816*a* to 1816*f* with mold resin can be simplified, and also, the amount of usage of mold resin can be moderate.

Although in the present embodiment, the primary mold resin coating is covered with mold resin to form the secondary mold resin coating so that the fixing pin marks formed when the primary mold resin coating is formed can be filled with resin, the present invention is not limited to this, but only the concave portions of the pin marks may be filled with mold resin.

In the present embodiment, on a surface of the center core 18*a* fitted into a central space of the coil assembly 10 among the cores forming the closed magnetic path, a plurality of projections 40 (see FIG. 3) as guide ribs having the same height are provided in the longitudinal direction and the outer circumferential direction of the center core 18*a*. The height of the projections 40 is, for example, 0.05 mm to 0.6 mm.

Because the plurality of projections 40 having the same height are provided on the surface of the center core 18*a* in the longitudinal direction and the outer circumferential direction thereof, the center core 18*a* can be positioned in an effective manner by the projections coming into contact with an inner peripheral surface of the primary coil bobbin 11. As a result, the gap between the inner peripheral wall of the primary coil bobbin 11 and an outer surface of the center core 18*a* of the core 18 fitted into the primary coil bobbin 11 can be maintained uniform, and hence stress acting on insulating resin as the casting material in the ignition coil can be made uniform, and cracking of the insulating resin can be prevented.

In the present embodiment, one end of the core 18 that forms the closed magnetic path is coated with an elastic member.

One end of the core 18, for example, an end 1815 of the core 18 that is located at an opening end of the housing 1 when the coil assembly 10 is fitted into the housing 1 has a magnetic material exposed portion because of insert molding. If the magnetic material exposed portion is coated using, for example, a directional silicon steel sheet, the effect of magnetostriction cannot be neglected. Similarly, if the casting material is injected with the magnetic material exposed portion left as it is, the effect of magnetostriction cannot be neglected. Thus, in the present embodiment, the above described magnetic material exposed end is coated with an elastic member.

Specifically, for example, the mold resin coating that coats the exposed end 1815 of the core 18 is raised by a predetermined height, for example, 1 mm to 2 mm from the magnetic material exposed end face so as to form a peripheral wall surrounding the magnetic material exposed end face so that the exposed end 1815 can be the bottom surface of the concave portion. Then, the elastic member having a thickness of, for example, 1 mm to 2 mm, which is the same level of thickness as the height of the mold resin coating projecting out from the exposed end face, is disposed in the concave portion surrounded by the mold resin coating and then thermally caulked by the mold resin coating.

A foamed sponge made of silicon rubber, for example, is suitably used as the elastic member. In this case, it is preferred that the foamed sponge as the elastic member is provided with through holes penetrating therethrough in the direction of thickness. This enables a void and a casting material to be smoothly passed through the foamed sponge during injection of the casting material.

In the present embodiment, the central point of the primary coil in the winding width (the longitudinal direction of the primary coil bobbin 11) is shifted by a predetermined width from the central point of the secondary coil in the winding width (the longitudinal direction of the secondary coil bobbin 12) toward the secondary coil 27*b* having the secondary output terminal 23 connected to one ignition plug via a high tension cord and the H/T tower 4.

As described above, the ignition coil according to the present embodiment is of the dual ignition type having the two secondary output terminals (22 and 23) and is applied to an engine having two ignition plugs in one cylinder. One (22) of the secondary output terminals is directly connected to one of the ignition plugs, and the other one (23) of the secondary output terminals is connected to the other one of the ignition plugs via the high-tension cord. Here, the floating capacitance at the secondary output terminal 23 connected to the ignition plug via the high-tension cord is greater than the floating capacitance at the secondary output terminal 22 directly connected to the ignition plug.

In general, an output voltage from an output terminal with high floating capacitance is lower than an output voltage from an output terminal with low floating capacitance. To solve this problem, in the present embodiment, the central point of the primary coil in the direction of the winding width is shifted by a predetermined width, for example, 1.5 mm to 3.0 mm from the central point of the secondary coil in the direction of the winding width toward the secondary coil 27*b* having the secondary output terminal 23 with high floating capacitance, whereby the binding coefficient K of the primary coil and the secondary coil at the secondary output terminal 23 with high floating capacitance is increased to compensate for a decrease in secondary output resulting from an increase in floating capacitance, and voltages output from the two secondary output terminals 22 and 23 are balanced.

In the present embodiment, a plurality of guide ribs for positioning the coil assembly 10 with respect to an inner wall surface of the housing 1 are provided on an outer surface of the secondary coil bobbin 12 as the constructional member of the coil assembly 10.

Figure 6:
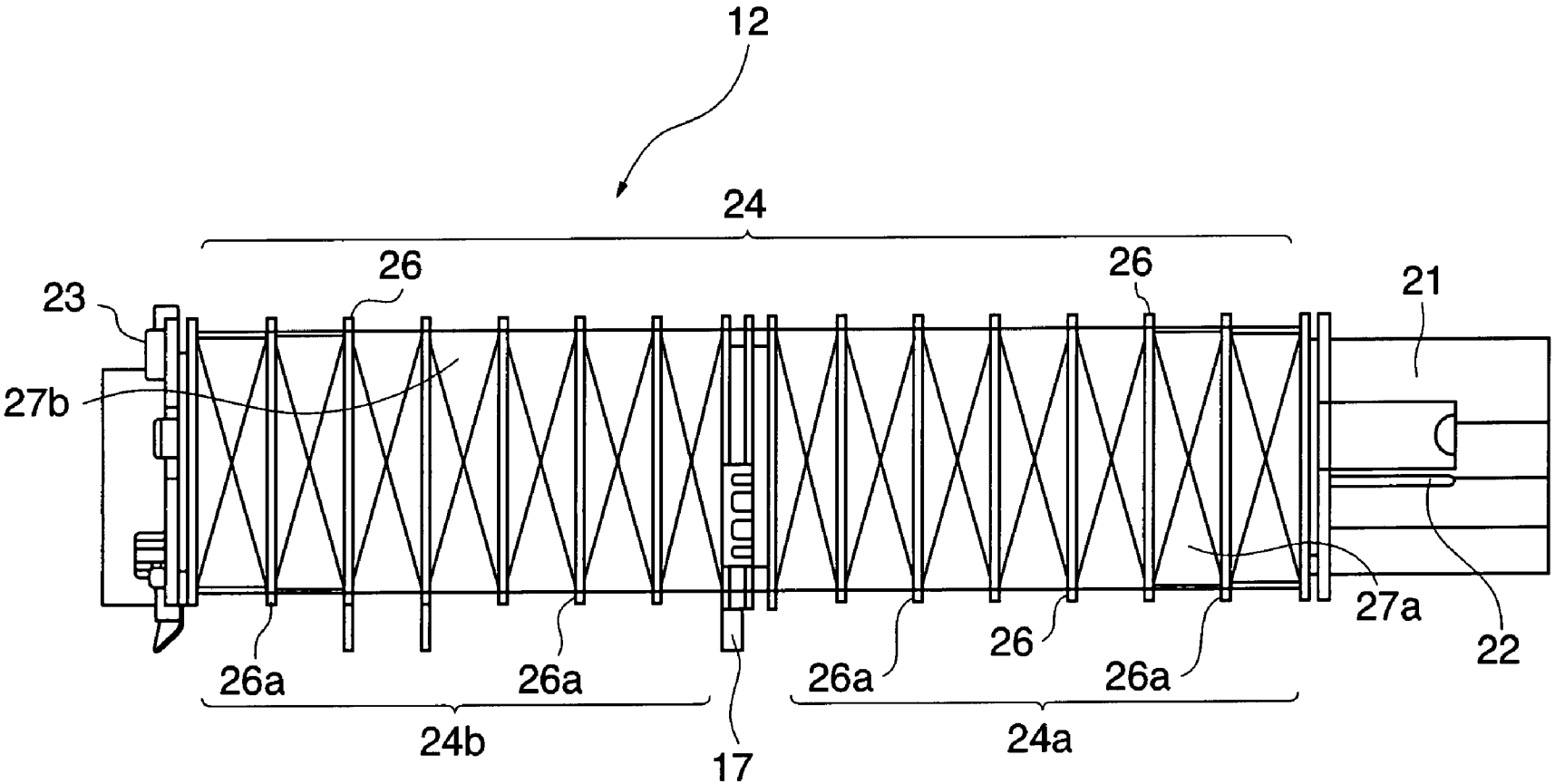
FIG. 6 is a plan view showing a secondary coil bobbin that is a constructional member of the coil assembly.
Figure 7:
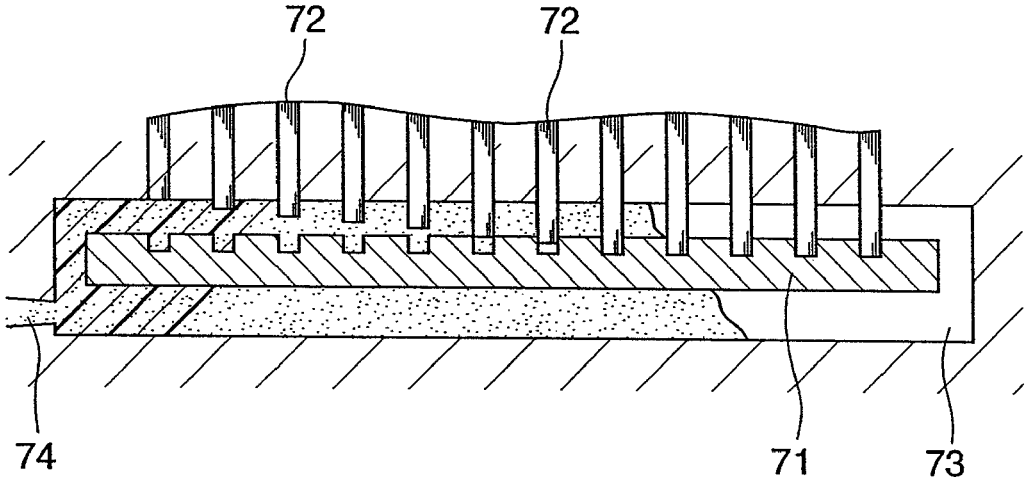
FIG. 7 PRIOR ART
FIG. 7 is a sectional view useful showing a mold for use in a method of manufacturing an insert-molded product (prior art)
Figure 8:
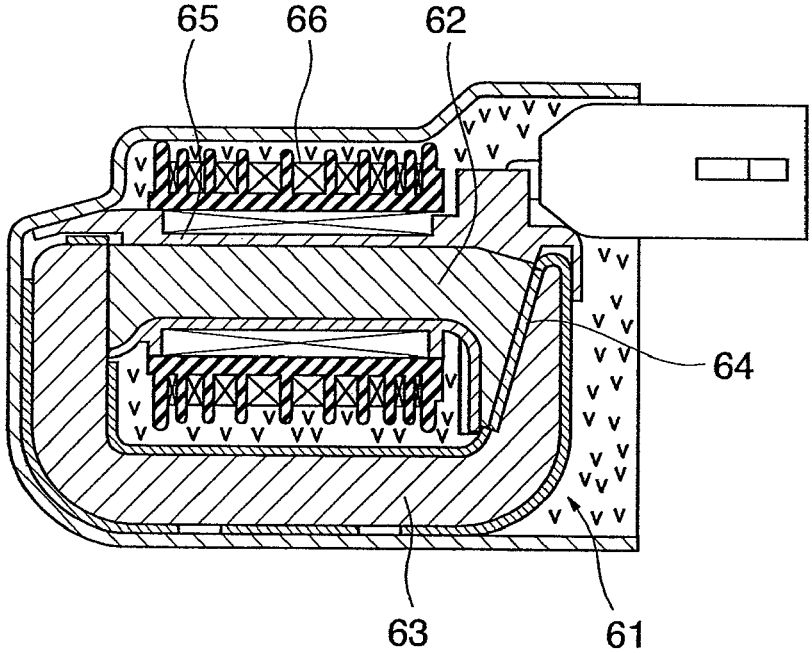
FIG. 8 PRIOR ART
FIG. 8 is a longitudinal sectional view showing a conventional ignition coil.
Figure 9:
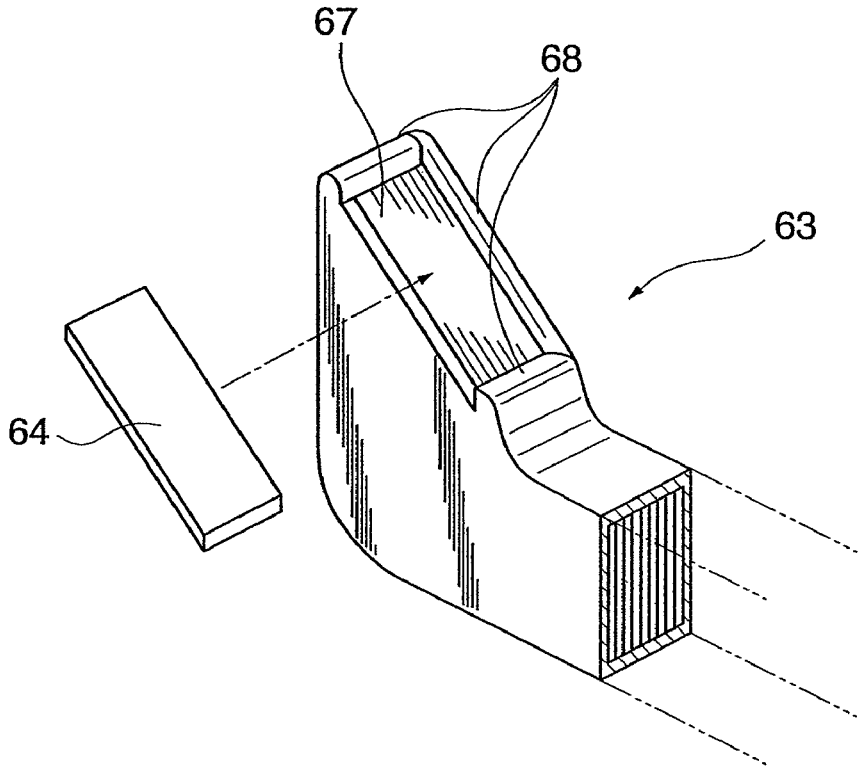
FIG. 9 PRIOR ART
FIG. 9 is a partially enlarged view showing a closed magnetic path forming portion of a core appearing in FIG. 8.
Figure 10:
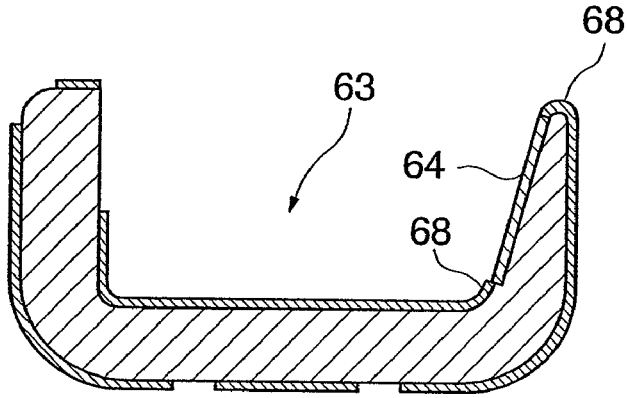
FIG. 10 PRIOR ART
FIG. 10 is a longitudinal sectional view showing the closed magnetic path forming portion in FIG. 8.

FIG. 6 is a plan view showing the secondary coil bobbin 12.

As shown in FIG. 6, the secondary coil bobbin 12 is comprised mainly of a cylindrical secondary coil bobbin main body 21 made of, for example, modified PPO (polyphenylene oxide) resin, and the first secondary output terminal 22 and the second secondary output terminal 23 provided at respective ends of the secondary coil bobbin main body 21 in the longitudinal direction thereof.

An outer surface of the secondary coil bobbin main body 21 is a winding area 24 around which coils are wound. The above described midtap 17 is provided in substantially the center of the winding area 24 and divides the winding area 24 into a first winding area 24*a* and a second winding area 24*b*. Each of the winding areas 24*a* and 24*b* is partitioned, for example, at regular intervals by a plurality of partition plates 26 extended in the direction of the normal to an outer peripheral surface of the secondary coil bobbin main body 21.

Coils are wound in opposite directions (reversely wound) around the first winding area 24*a* and the second winding area 24*b* of the winding area 24 divided by the midtap 17, so that the secondary coils 27*a* and 27*b* wound in opposite directions are formed.

Ends of the secondary coils 27*a* and 27*b* on the midsection side of the secondary coil bobbin 12 are connected to the midtap 17. On the other hand, the other end of the first secondary coil 27*a* is connected to the first secondary output terminal 22, and the other end of the second secondary coil 27*b* is connected to the second secondary output terminal 23. The two secondary output terminals 22 and 23 are connected to secondary high-voltage terminals (terminals connected to the H/T tower 4, the plug cap 7, and so on) by fitting the coil assembly 10 into the housing 1, whereby high-voltage output is taken out.

Arbitrary ones (four ones in FIG. 6) of the plurality of partition plates 26 that partition the winding areas 24*a* and 24*b* at regular intervals, for example, the second partition plates and the outermost partition plates as viewed from the midtap 17 in the first winding area 24*a* and the second winding area 24*b* are constructed as ribbed partition plates 26*a* that have on outer peripheral portions thereof projections that should be guide ribs 28 for positioning. It should be noted that a limited area in which no guide rib is provided is formed on a surface of the secondary coil bobbin 12 which faces the mounting flange 5 across the wall of the housing 1 so as to prevent distortion on joint surfaces of insulating resin as a hardened casting material and guide ribs.

The above described coil assembly 10, which has the primary coil and the secondary coil and in which the center core 18*a* of the core 18 forming the closed magnetic path is fitted into the central space of the coil pair including the primary coil and the secondary coil arranged concentrically, is fitted into the housing 1 having the mounting flange 5 on the outer surface thereof, and with the coil assembly 10 being positioned in the housing 1, insulating resin is filled into the gaps between the constructional members, so that the ignition coil according to the present embodiment is formed.

The ignition coil thus formed is fixed at a predetermined location of the engine block, and one secondary output terminal 22 is directly connected to one ignition plug mounted on a plug hole of an engine and engaged with the plug cap 7 mounted on, for example, a lower end of the housing 1. The other secondary output terminal 23 is connected to the other ignition plug disposed in the same cylinder via the high-tension cord. Each of the secondary output terminals 22 and 23 outputs a secondary output voltage to act as an engine ignition source.

According to the present embodiment, because the magnet 20 of the core 18 is housed in the housing space surrounded by the inclined joint surfaces 181*a* and 182*a* of the core members 181 and 182 and the insulation coating 1813 provided such as to project out form the inclined joint surfaces 181*a* and 182*a*, the magnet 20 does not expose itself from the insulation coating of the core 18 and thus does not contact insulating resin as the casting material. As a result, distortion of the insulating resin in the vicinity of the edge of the magnet 20 can be suppressed, and hence cracking of the insulating resin can be prevented.

Moreover, according to the present embodiment, because the joint surfaces forming one joint portion are the inclined joint surfaces 181*a* and 182*a*, the magnet 20 increased in size can be interposed between them, resulting in secondary output increasing.

According to the present embodiment, because the core as the constructional member of the ignition coil is coated with mold resin, and mold resin is further filled into the pin marks 1814*a* to 1814*f* and 1816*a* to 1816*f*, which are formed on the mold resin coating by removal of the core fixing pins when the mold resin coating is formed so as to fill up the concave portions of the pin marks, distortion at boundaries between the concave portions of the pin marks on the surface of the core and insulating resin as the casting material can be suppressed, and hence cracking of the insulating resin can be prevented.

Although in the present embodiment, the ignition coil is of the dual ignition type having two secondary output terminals, the present invention is not limited to this, but the present invention may be applied to ignition coils having only one secondary output terminal, and other types of ignition coils.

What is claimed is:

1. An ignition coil, comprising:

a coil case;

a coil assembly housed in said coil case; and a casting material filled into a gap between said coil case and said coil assembly and gaps of said coil assembly, wherein said coil assembly has a coil pair including a cylindrical primary coil and a secondary coil disposed concentrically with the primary coil and a core that is fitted into a central space of the coil pair and forms a magnetic path, the core has a primary mold resin coating, which covers a surface of the core and is not made of said casting material, and a secondary mold resin coating, which covers the primary mold resin coating and is not made of said casting material, and concave portions of pin marks formed on the primary mold resin coating by removal of core fixing pins when the primary mold resin coating is formed are filled with the secondary mold resin coating.

2. The ignition coil as claimed in claim 1, wherein the core comprises a combination of a plurality of core members and forms a closed magnetic path in which the plurality of core members are joined together with a permanent magnet placed in at least one joint portion of the plurality of core members, the plurality of core members except joint surfaces thereof are coated with the primary and secondary mold resin coatings, and the permanent magnet is housed in a housing space that is surrounded by two joint surfaces forming the one joint portion of the plurality of core members and at least one of the primary and secondary mold resin coatings projecting out from the joint surfaces.

3. The ignition coil as claimed in claim 1, wherein a film thickness of the secondary mold resin coating is 0.5 mm to 2.0 mm.

4. The ignition coil as claimed in claim 1, wherein the coil pair includes the primary coil wound around a cylindrical primary coil bobbin, and the secondary coil wound around a cylindrical secondary coil bobbin that has a larger diameter than a diameter of the primary coil bobbin and is disposed concentrically with the primary coil bobbin, and at least part of the core is fitted into a central space of the primary coil bobbin.

5. The ignition coil as claimed in claim 1, wherein the casting material is insulating resin.

6. An ignition coil, comprising:

a coil case;

a coil assembly housed in said coil case; and a casting material filled into a gap between said coil case and said coil assembly and gaps of said coil assembly, wherein said coil assembly has a coil pair including a cylindrical primary coil and a secondary coil disposed concentrically with the primary coil and a core that is fitted into a central space of the coil pair and forms a magnetic path, the core forms a closed magnetic path in which a plurality of separable core members are joined together with a permanent magnet placed in at least one joint portion of the core members, the plurality of core members except joint surfaces thereof are coated with mold resin coatings which are not made of said casting material, and the permanent magnet is housed in a housing space that is surrounded by two joint surfaces forming the one joint portion of the core members and the mold resin coatings projecting out from the joint surfaces.

7. The ignition coil as claimed in claim 6, wherein the coil assembly comprises the primary coil wound around a cylindrical primary coil bobbin, and the secondary coil wound around a cylindrical secondary coil bobbin that has a larger diameter than a diameter of the primary coil bobbin and is disposed concentrically with the primary coil bobbin, and at least part of the core is fitted into a central space of the primary coil bobbin.

8. The ignition coil as claimed in claim 6, wherein the casting material is insulating resin.

9. The ignition coil as claimed in claim 6, wherein the respective mold resin coatings partially project out from outer peripheral portions of the two joint surfaces, which are opposed, of the one joint portion, and through engagement of the partially projecting mold resin coatings, the partially projecting mold resin coatings cover the total circumferences of the joint surfaces to form the housing space.

10. The ignition coil as claimed in claim 6, wherein the two joint surfaces forming the one joint portion, in which the permanent magnet is placed, are inclined at a predetermined angle to a direction in which the plurality of core members are joined together.

11. The ignition coil as claimed in claim 6, wherein a joint portion other than the one joint portion has a concave surface and a convex surface that are joined together.

12. The ignition coil as claimed in claim 6, wherein the core forms the closed magnetic path through engagement of substantially square U-shaped two core members.

* * * * *